US005811369A

United States Patent [19]

Nagai et al.

[11] Patent Number: 5,811,369

[45] Date of Patent: Sep. 22, 1998

[54] THERMAL RECORDING MEDIUM

[75] Inventors: Tomoaki Nagai; Kaoru Hamada, both of Shijuku-ku; Akio Sekine, Kita-ku, all of Japan

[73] Assignee: Nippon Paper Industries Co., Ltd., Tokyo, Japan

[21] Appl. No.: 757,766

[22] Filed: Nov. 27, 1996

[30] Foreign Application Priority Data

Dec. 1, 1995 [JP] Japan ..... 7-313910

[51] Int. Cl.[6] ..... B41M 5/30

[52] U.S. Cl. ..... 503/209; 503/216; 503/225

[58] Field of Search ..... 427/150, 151; 503/208, 209, 216, 225

[56] References Cited

U.S. PATENT DOCUMENTS

| | | | |
|---|---|---|---|
| 4,570,170 | 2/1986 | Hiraishi et al. | 503/209 |
| 5,665,675 | 9/1997 | Nagai et al. | 503/216 |

FOREIGN PATENT DOCUMENTS

| | | | |
|---|---|---|---|
| 0776769 | 6/1997 | European Pat. Off. | 503/209 |
| 2432938 | 3/1980 | France | 503/209 |
| 51-27599 | 8/1976 | Japan | 503/214 |
| 56-146794 | 11/1981 | Japan | 503/209 |
| 57-188394 | 11/1982 | Japan | 503/209 |
| 59-114096 | 6/1984 | Japan | 503/216 |
| 62-164579 | 7/1987 | Japan | 503/216 |
| 4-353490 | 12/1992 | Japan | 503/216 |
| 8-282123 | 4/1994 | Japan | 503/216 |
| 6-179289 | 6/1994 | Japan | 503/209 |
| 7-32744 | 2/1995 | Japan | 503/209 |
| 7-304727 | 11/1995 | Japan | 503/216 |
| 8-058242 | 3/1996 | Japan | 503/216 |
| 8-290672 | 3/1996 | Japan | 503/216 |
| 8-238851 | 9/1996 | Japan | 503/217 |
| 8-282117 | 10/1996 | Japan | 503/217 |
| 8-282120 | 10/1996 | Japan | 503/217 |
| 8-282121 | 10/1996 | Japan | 503/217 |
| 8-282122 | 10/1996 | Japan | 503/217 |
| 8-310134 | 11/1996 | Japan | 503/216 |
| 8-324127 | 12/1996 | Japan | 503/216 |

OTHER PUBLICATIONS

Patent Abstracts of Japan, vol. 96, No. 3, 29 Mar. 1996 & JP 07 304727 A (Nippon Paper Industrial Co. Ltd.), 21 Nov. 1995.

Patent Abstracts of Japan, vol. 7, No. 37 (M–193), 15 Feb. 1983 & JP 57 188394 A (Ricoh K.K.), 19 Nov. 1982.

Patent Abstracts of Japan, vol. 18, No. 521 (M–1681), 30 Sep. 1994 & JP 06 179289 A (Nippon Kayaku Co. Ltd), 28 Jun. 1994.

*Primary Examiner*—Bruce H. Hess

*Attorney, Agent, or Firm*—Sherman and Shalloway

[57] ABSTRACT

A thermal recording medium comprising a substrate having thereon a recording layer containing a colorless or pale colored dye precursor, and a color developer reactable with the dye precursor to develop a color as main ingredients, wherein the color developer includes at least one compound of Formula (1): and the recording layer contains at least one methylolated fatty acid amide of Formula (2):

(1)

(wherein X denotes oxygen atom or sulfur atom; and R denotes substituted or unsubstituted phenyl group, naphthyl group, aralkyl group, a lower alkyl group of 1 to 6 carbon atoms, a cycloalkyl group of 3 to 6 carbon atoms, or a lower alkenyl group of 2 to 6 carbon atoms. Z denotes a lower alkyl group of 1 to 6 carbon atoms or an electron attracting group. n is an integer from 0 to 4, and p is an integer from 1 to 5, satisfying n+p ≦5.).

$$R_1\text{-}CONHCH_2OH \quad (2)$$

(wherein $R_1$ denotes an alkyl group of 11 to 21 carbon atoms).

29 Claims, No Drawings

THERMAL RECORDING MEDIUM

FIELD OF THE INVENTION

This invention relates to a thermal recording medium which is superior in thermal resistance and plasticizer resistance.

BACKGROUND OF THE INVENTION

In general, a thermal recording medium is obtained by mixing a normally colorless or pale colored dye precursor and a color developer such as a phenolic compound, each dispersed to fine particles and mixed, adding a binder, a filler, a sensitizer, a slip agent, and other additives to form a coating color, and coating the coating color on a substrate such as paper, synthetic paper, films, or plastics, which develops a color by a momentary chemical reaction caused by heating with a thermal head, a hot stamp, a thermal pen, laser light or the like to obtain a recorded image.

These thermal recording media are applied in a wide variety of fields such as measuring recorders, terminal printers for computers, facsimiles, automatic ticket venders, and bar code labels. However, with recent diversification of these recording devices and advance towards higher performance, quality requirements for thermal recording medium have become higher and more difficult to achieve. For example, for high-speed recording, a thermal recording medium is required to provide a sharp image of high recording density even with a small thermal energy. On the other hand, in view of storage stability of recording medium, a thermal recording medium is required which is superior in light resistance, thermal resistance, water resistance, oil resistance, and plasticizer resistance.

However, a prior art thermal recording medium having thereon a thermal recording layer mainly comprising a dye precursor, a color developer and a binder coated on the substrate has been known to have a problem in that the recorded image tends to discolor with a time lapse. Such discoloration is accelerated under light, high-temperature, or high-humidity environment, further, considerably advanced by immersion in water for a long time, contact with an oil such as salad oil, or a plasticizer contained in wrap films or the like, and the recorded image becomes unreadable.

In order to suppress such discoloration of the recorded image, various technologies have been disclosed on thermal recording media mainly comprising a dye precursor and a color developer. For example, Japanese Patent Laid-open Publication (OPI) 60-78782 and Japanese OPI 59-114096 use a phenolic antioxidant, which is mixed in the thermal recording layer, Japanese OPI 56-146794 uses a hydrophobic polymer compound as protective layer, and Japanese OPI 62-164579 uses a phenolic color developer in combination with an epoxy compound. However, the effect of these additives against plasticizers is not sufficient, and the problem of discoloration due to a time lapse has yet been remained.

Further, with recent popularization of plain paper recording system such as electrophotographic or ink-jet systems, the thermal recording system has become often compared with these plain paper recording systems. For example, stability of unrecorded portion (background portion or white portion) before and after recording is required to be closer in quality to that of plain paper recording, as in the case of toner recording. Further, the thermal recording medium is required to have a background color stability to heat of above 100° C. because the thermal recording medium is used as a label for foodstuffs which are subjected to sterilization at high temperatures, and in cards such as skiing lift tickets which are heat laminated.

As to the background color stability of thermal recording material, Japanese OPI 04-353490 discloses a thermal recording material containing 3-dibutylamino-7-(o-chloroanilino) fluoran as a dye, 4-hydroxydiphenylsulfone compound having a melting point of above 120° C., and a mixture of sodium salt of 2,2'-methylenebis(4,6-di-tert-butylphenyl)phosphate and magnesium silicate having a good background color and recorded image stability even at a high temperature of about 90° C.

Further, the inventors have described a thermal recording medium using an aminobenzenesulfonamide derivative as a color developer as a thermal recording medium having a thermal resistance to high temperatures of above 100° C. in the specifications of Japanese OPIs 07-304727, 08-25810, 08-53407, 08-59603, and 08-132739, and Japanese Patent Applications 07-97021 and 07-122393, or 07-250789. However, these thermal recording media are superior in thermal resistance, but dissatisfactory in terms of plasticizer resistance.

On the other hand, Japanese Patent Publication 51-27599, with the aim of preventing color development due to pressure and improving the sensitivity, proposes the use of a combination of a fatty acid amide and a petroleum wax in the thermal recording medium, and describes the use of methylolated fatty acid amide. However, this method has a problem in thermal stability of the background portion, and resistance to background color development is rather impaired when placed at a temperature of about 100° C.

Further, Japanese OPI 57-188394 proposes the use of benzyl p-oxybenzoate as a color developer, in combination with methylolated fatty acid amide. The resulting recording medium is good in thermal resistance of background portion at 40° C. 90% RH. However, it has a problem in that the background color is developed at about 100° C., and the image is discolored due to plasticizer.

Further, Japanese OPI 06-179289 proposes the use of a specific dye precursor and methylolated behenamide. However this method only provides a thermal stability of background color at 60° C. As to the plasticizer resistance, a test is carried out on a thermal recording medium provided thereon with a protective layer, and when the protective layer is removed, discoloration occurs in the recorded image and no plasticizer resistance is noted.

The thermal recording medium disclosed in Japanese OPI 04-353490 has a thermal stability of background color such that a Macbeth density of the background color is 0.11 after the medium is treated in a hot air dryer at 95° for 5 hours, which is fairly good in stability, but is yet insufficient in terms of heat resistance temperature. Therefore, a primary object of the present invention is to provide a thermal recording medium which has a high thermal resistance and is superior in plasticizer resistance of the recorded image and background color (unrecorded portion).

SUMMARY OF THE INVENTION

The above object is attained by a thermal recording medium comprising a substrate having thereon a recording layer containing a colorless or pale colored dye precursor, and a color developer reactable with the dye precursor to develop a color as main ingredients, wherein the color developer includes at least one compound of Formula (1): and the recording layer contains at least one methylolated fatty acid amide of Formula (2):

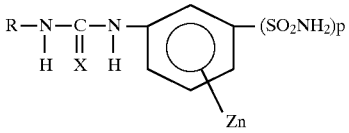

(1)

(wherein X denotes oxygen atom or sulfur atom; and R denotes substituted or unsubstituted phenyl group, naphthyl group, aralkyl group, a lower alkyl group of 1 to 6 carbon atoms, a cycloalkyl group of 3 to 6 carbon atoms, or a lower alkenyl group of 2 to 6 carbon atoms. Z denotes a lower alkyl group of 1 to 6 carbon atoms or an electron attracting group. n is an integer from 0 to 4, and p is an integer from 1 to 5, satisfying n+p ≦5).

$$R_1\text{-}CONHCH_2OH \quad (2)$$

(wherein $R_1$ denotes an alkyl group of 11 to 21 carbon atoms).

The aminobenzenesulfonamide derivative of Formula (1) used as a color developer in the present invention is considered to undergo a structural change from a neutral structure (keto-form in the case of urea) shown by Formula (1) to an acid structure (enol-form in the case of urea) to exhibit a color developing function. Since, the thermal head for supplying heat momentarily has a high temperature of above 200° to 300° C., the compound of Formula (1) contained in the recording layer of the thermal recording medium contacting the thermal head undergoes the tautomerism to be the acid form, exhibiting the color developing function. This opens the lactone ring of the dye precursor to develop a color.

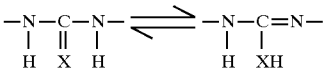

(wherein X is oxygen atom or sulfur atom).

The above tautomerization indispensably requires a high temperature, but is little caused by a plasticizer or the like. Therefore, when compounds of these structures are used as a color developer, the problem of background color development is minimized since the color developing reaction is not caused even if the background portion is contacted with a plasticizer.

Further, since the temperature at which the compound of Formula (1) transforms to the acid structure (enol-form or thiol-form) is considered to be higher than the temperature required for heat lamination or heat sterilization, the structure is not changed to the acid form even under a high-temperature environment, the thermal stability of background portion is improved.

Further, in the aminobenzenesulfonamide derivative of Formula (1), the aminosulfonyl group (—$SO_2NH_2$) is considered to contribute to promotion of the color developing function and stabilization of the acid form.

In order to stabilize the acid structure which is considered to exhibit a color developing function after heating, it is sufficient that an aromatic ring having an aminosulfonyl group (—$SO_2NH_2$) is present at the N-position (or 1-position) of the urea or thiourea structure of Formula (1) of the present invention. When the aminosulfonyl group (—$SO_2NH_2$) is present at the ortho- or meta-position with respect to the urea or thiourea structure, the compound is better in color developing function with a lower thermal energy (recording energy) compared with that of para-position, which can be preferably used.

Therefore, R in Formula (1) may be one which does not hinder the color developing function or stability, for example, substituted or unsubstituted phenyl group, naphthyl group, aralkyl group, a lower alkyl group of 1 to 6 carbon atoms, a cycloalkyl group of 3 to 6 carbon atoms, or a lower alkenyl group of 2 to 6 carbon atoms. Further, R in Formula (1) may include a substituent which does not hinder the color development and stability. The substituent includes lower alkyl groups of 1 to 6 carbon atoms such as methyl group or ethyl group; lower alkenyl groups such as isopropenyl group; or an electron attracting group such as fluorine, chlorine, bromine, or nitro group. Further, Z in Formula (1) may be a substituent which does not hinder the color developing function and stability. Such a substituent includes lower alkyl groups of 1 to 6 carbon atoms such as methyl group or ethyl group; or an electron attracting group such as fluorine, chlorine, bromine, or nitro group.

Practical examples of the compound of Formula (1) include, but are not limited to, (A-1) to (A-54), or (B-1) to (B-18) shown below.

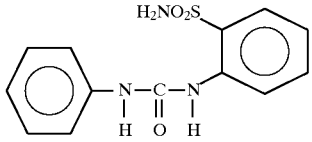

(A-1)

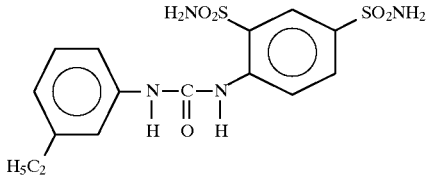

(A-2)

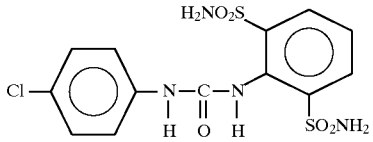

(A-3)

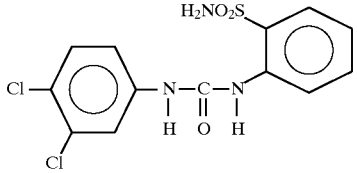

(A-4)

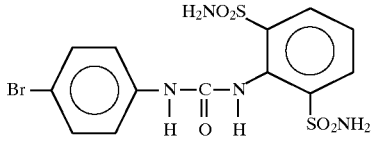

(A-5)

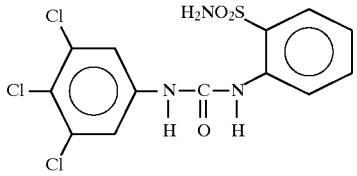

(A-6)

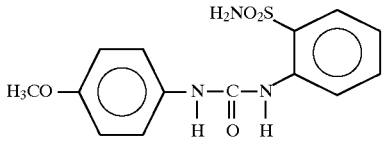

(A-7)

-continued
(A-8)
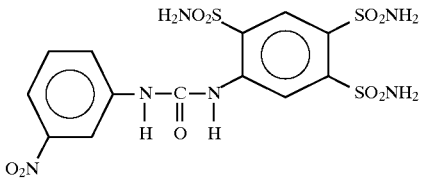
(A-9)
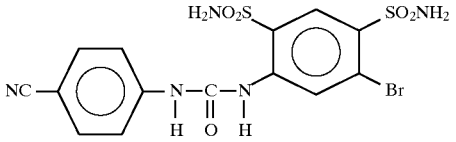
(A-10)
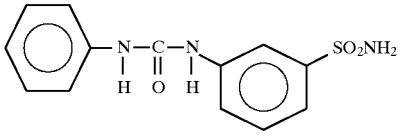
(A-11)
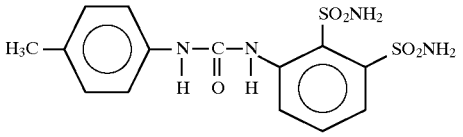
(A-12)
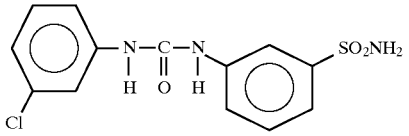
(A-13)
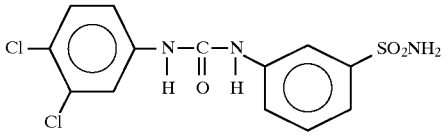
(A-14)
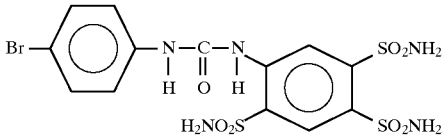
(A-15)
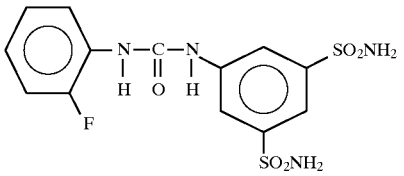
(A-16)
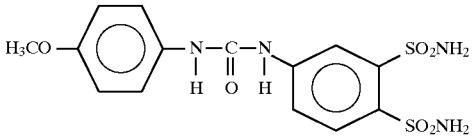
(A-17)
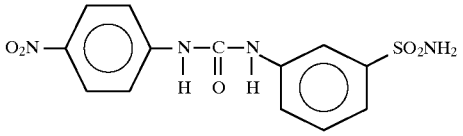
-continued
(A-18)
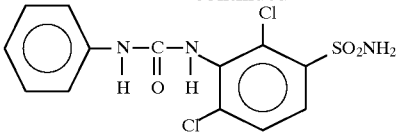
(A-19)
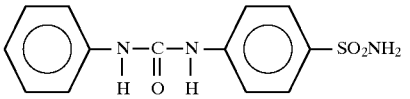
(A-20)
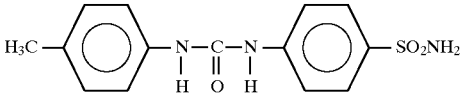
(A-21)
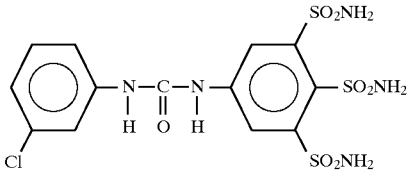
(A-22)
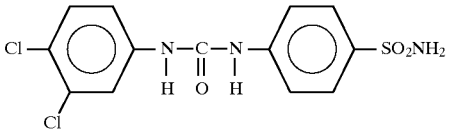
(A-23)
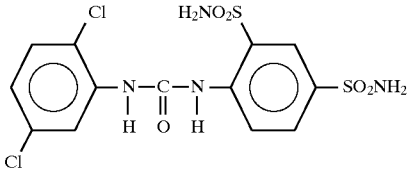
(A-24)
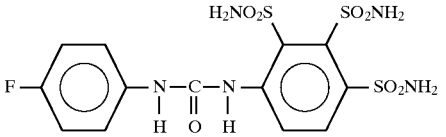
(A-25)
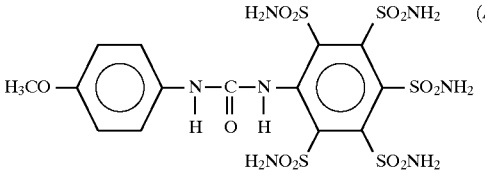
(A-26)
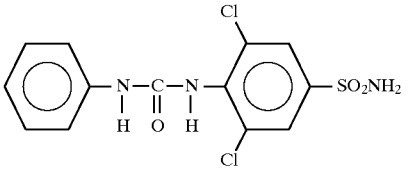
(A-27)
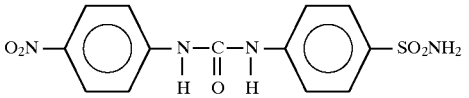
(A-28)
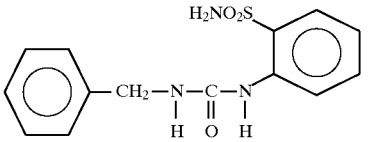

-continued
(A-29)
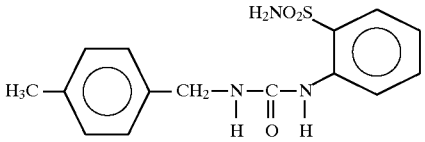
(A-30)
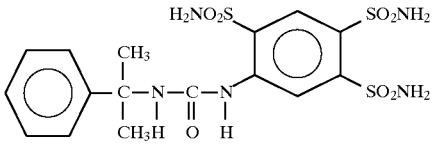
(A-31)
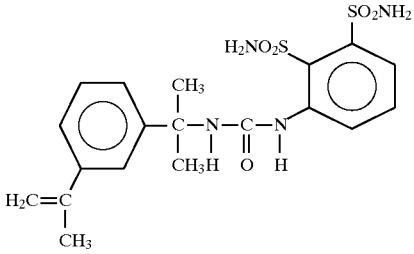
(A-32)
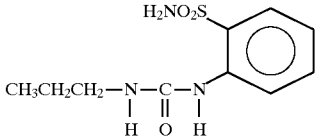
(A-33)
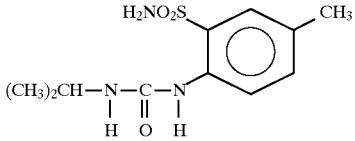
(A-34)
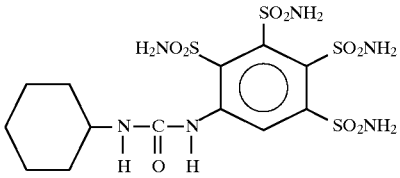
(A-35)
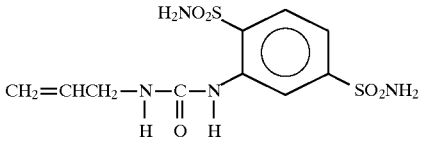
(A-36)
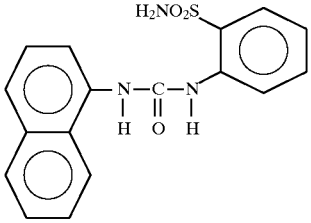
(A-37)
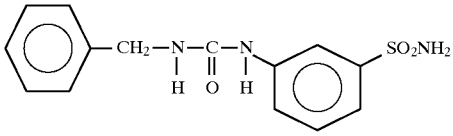
-continued
(A-38)
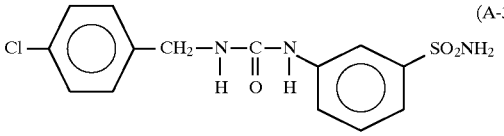
(A-39)
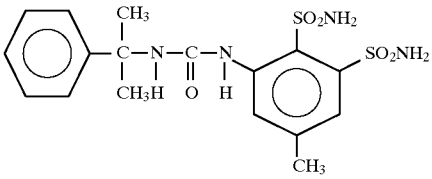
(A-40)
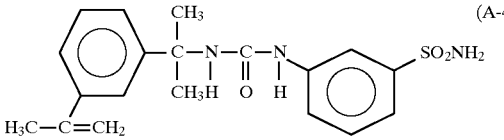
(A-41)
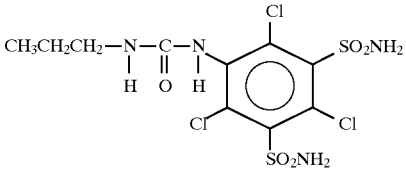
(A-42)
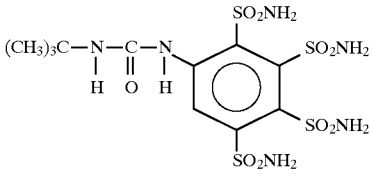
(A-43)
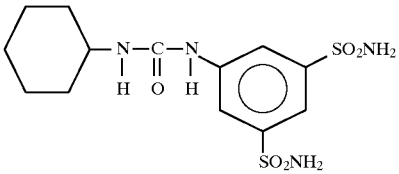
(A-44)
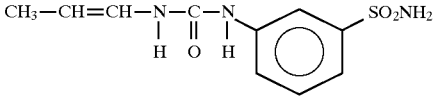
(A-45)
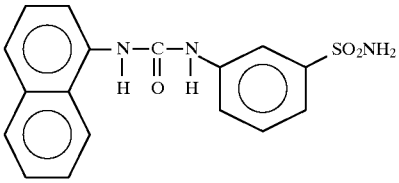
(A-46)
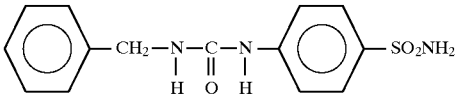
(A-47)
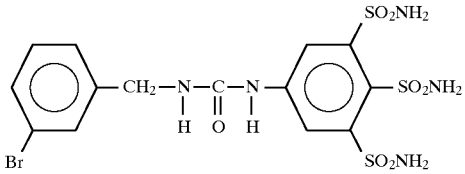

-continued
(A-48)
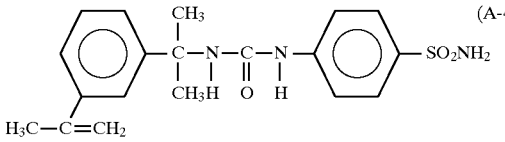
(A-49)
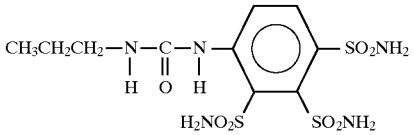
(A-50)
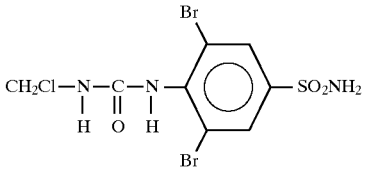
(A-51)
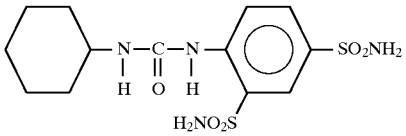
(A-52)
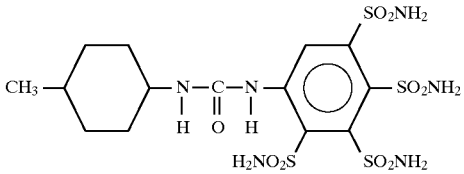
(A-53)
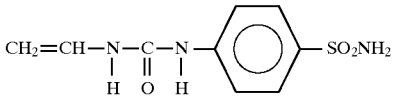
(A-54)
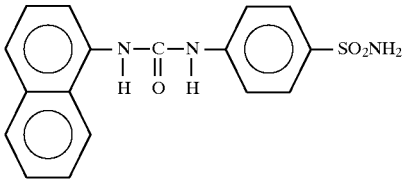
(B-1)
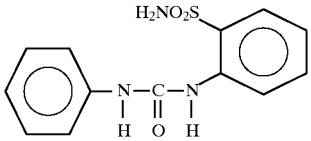
(B-2)
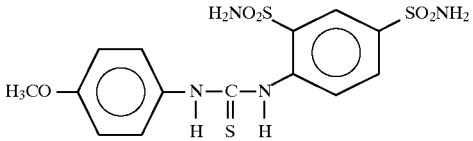
(B-3)
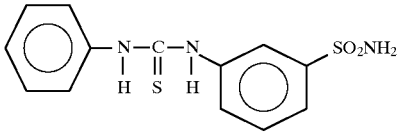
-continued
(B-4)
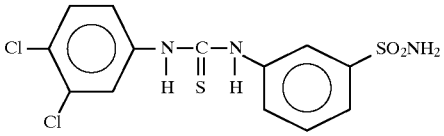
(B-5)
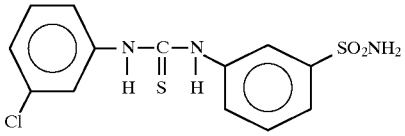
(B-6)
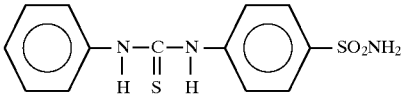
(B-7)
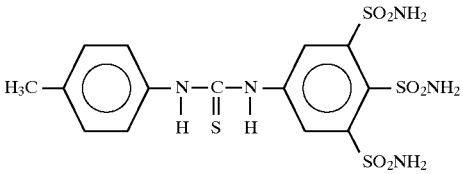
(B-8)
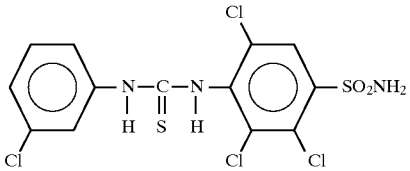
(B-9)
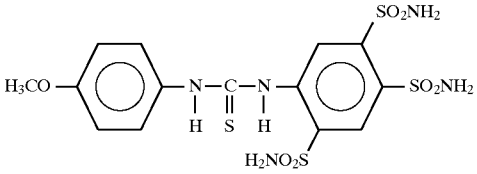
(B-10)
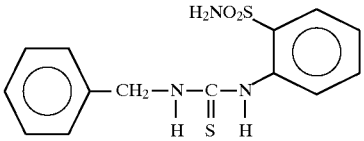
(B-11)
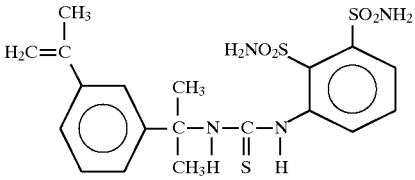
(B-12)
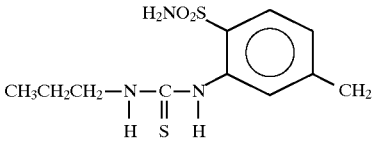
(B-13)
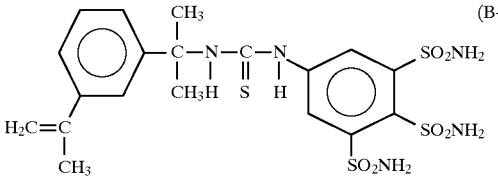

-continued (B-14)

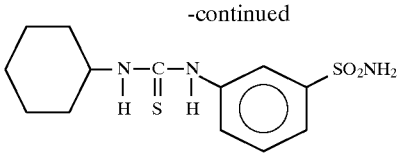

(B-15)

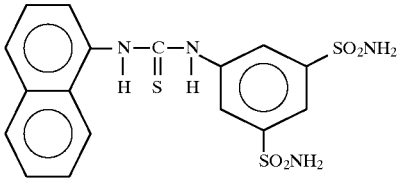

(B-16)

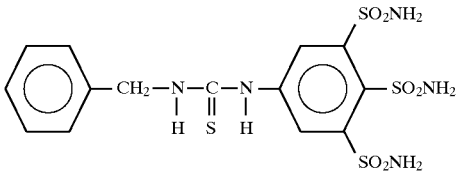

(B-17)

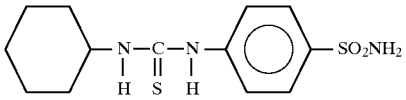

(B-18)

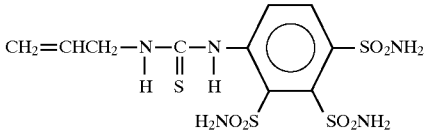

On the other hand, the methylolated fatty acid amide of Formula (2) used in the thermal recording medium according to the present invention has heretofore been one which, as described above, rather impairs the thermal resistance. However, surprisingly, when it is used in combination with the aminobenzenesulfonamide derivative of Formula (1) of the present invention, the thermal recording medium of the present invention is provided with an even higher plasticizer resistance, while maintaining the extremely high thermal resistance characteristic of the compound of Formula (1). When a fatty acid amide such as stearamide or palmitamide is added to the thermal recording layer of the present invention in place of the methylolated fatty acid amide, plasticizer resistance cannot be provided in addition to a sensitization effect. A strong plasticizer resistance effect is noted only when the methylolated fatty acid amide is simultaneously present.

The methylolated fatty acid amide of Formula (2) has a structure that hydrogen of the terminal amino group of the fatty acid amide is substituted with methylol group. An example of the synthesis may be addition of formaldehyde to the fatty acid amide, and $R_1$ of Formula (2) is preferably an alkyl group of 15, 17, or 21 carbon atoms. These compounds may be used alone or as mixtures of two or more.

When the compound of Formula (1) once has the acid-form structure due to heat supplied by a thermal head, the methylolated fatty acid amide contributes to promote the effect of the aminosulfonyl group of Formula (1), thereby promoting the color developing function and stabilizing the acid-form structure. Reason for this effect has yet to be elucidated but is hypothesized as follows.

In general, in a thermal recording medium, when the color developer and the dye precursor react by thermal fusion, an exchange of electron occurs between both substances to form a kind of charge transfer complex, which then solidifies to yield a colored image. If a plasticizer adheres thereto, bonding in the complex is weakened, ultimately reverting to the original dye precursor and color developer resulting in discoloration. In the present invention, when the color developer of Formula (1) reacts with the dye precursor, the methylolated fatty acid amide is also thermally fused to be incorporated into the charge transfer complex, so that the acid-form of the compound of Formula (1) is stabilized and bonding force within the complex is maintained. Further, in the present invention, it is considered that by containing the methylolated fatty acid amide in the colored image, plasticizer becomes difficult to penetrate into the image.

In particular, in Formula (2) of the present invention, methylol group bonding to the terminal of the fatty acid amide is important. By substituting with the methylol group, for example, the reactivity becomes stronger than hydrogen of unsubstituted fatty acid amide, thereby promoting stabilization of the colored image. Therefore, a thermal recording medium with superior plasticizer resistance can be obtained which does not discolor even if contacted with a strong image discoloration substance such as plasticizer.

In the thermal recording medium of the present invention, the methylolated fatty acid amide is fused when a temperature of over 100° C. is applied, but the compound of Formula (1) will not change to the acid-form structure exhibiting the color developing function unless a high temperature of over 200° to 300° C. is applied. However, when a sensitizer or the lice is present and the fusion begins at a relatively low temperature, part of the compound of Formula (1) is fused with the sensitizer to increase the probability of transformation to the acid-form structure, and the color developing function is promoted. This causes development of background color though it is not regarded as a complete color development. On the other hand, the methylolated fatty acid amide used in the present invention, even if fused, is small in power to fuse the compound of Formula (1). Or, due to the substitution with the methylol group, it is considered that an equilibrium state is formed which is difficult to be changed to the acid-form structure.

The compound of Formula (1) of the present invention can be produced, for example, by a reaction of aminobenzenesulfonamides having aminosulfonyl group with isocyanate esters or isothiocyanate esters. In the reaction, 1 mole of aminobenzenesulfonamide is added to 1 to 2.5 mole of isocyanate esters or isothiocyanate esters. The solvent used may be one which dissolves aminobenzenesulfonamides, isocyanate esters, or isothiocyanate esters, including aromatic hydrocarbons such as benzene, toluene, and xylene; halogenated hydrocarbons such as chloroform, dichloromethane, and chlorobenzene; ethers such as diethylether, and tetrahydrofuran; nitrites such as acetonitrile, and propionitrile; esters such as ethylacetate; ketones such as acetone, and methylethylketone; non-proton donating polar solvents such as dimethylformamide, and dimethylsulfoxide; alcohols such as methanol, and ethanol; or mixtures thereof. The reaction temperature is 0° to 150° C.

A general method for producing the thermal recording medium of the present invention is that a dye precursor, at least one compound of Formula (1) as a color developer, and at least one methylolated fatty acid amide, along with a binder, are individually dispersed, and additives such as a filler, a slip agent, an ultraviolet absorbing agent, a water resistant agent, a defoamer, and the like are added as necessary, to produce a coating color, which is coated and dried on a substrate by a conventional method known in the art.

The dye precursor used in the present invention can be conventional ones which are known in the conventional pressure-sensitive or heat-sensitive recording paper area, and are not specifically limited, but triphenylmethane type compounds, fluoran type compound, fluorene type compounds, and divinyl type compounds are preferable. Typical dye precursors are shown below. These dye precursors may be used alone or in combination.

<Triphenylmethane type leuco dyes>

3,3-Bis(p-dimethylaminophenyl)-6-dimethylaminophthalide [Crystal Violet Lactone]

3,3-Bis(p-dimethylaminophenyl)phthalide [Malachite Green Lactone]

<Fluoran type leuco dyes>

3-Diethylamino-6-methylfluoran
3-Diethylamino-6-methyl-7-anilinofluoran
3-Diethylamino-6-methyl-7-(o,p-dimethylanilino)fluoran
3-Diethylamino-6-methyl-7-chlorofluoran
3-Diethylamino-6-methyl-7-(m-trifluoromethylanilino)fluoran
3-Diethylamino-6-methyl-7-(o-chloroanilino)fluoran
3-Diethylamino-6-methyl-7-(p-chloroanilino)fluoran
3-Diethylamino-6-methyl-7-(o-fluoroanilino)fluoran
3-Diethylamino-6-methyl-7-n-octylanilinofluoran
3-Diethylamino-6-methyl-7-benzylanilinofluoran
3-Diethylamino-6-methyl-7-dibenzylanilinofluoran
3-Diethylamino-6-chloro-7-methylfluoran
3-Diethylamino-6-chloro-7-anilinofluoran
3-Diethylamino-6-chloro-7-p-methylanilinofluoran
3-Diethylamino-6-ethoxyethyl-7-anilinofluoran
3-Diethylamino-7-methylfluoran
3-Diethylamino-7-chlorofluoran
3-Diethylamino-7-(m-trifluoromethylanilino)fluoran
3-Diethylamino-7-(o-chloroanilino)fluoran
3-Diethylamino-7-(p-chloroanilino)fluoran
3-Diethylamino-7-(o-fluoroanilino)fluoran
3-Diethylamino-benzo[a]fluoran
3-Diethylamino-benzo[c]fluoran
3-Dibutylamino-6-methyl-fluoran
3-Dibutylamino-6-methyl-7-anilinofluoran
3-Dibutylamino-6-methyl-7-(o,p-dimethylanilino)fluoran
3-Dibutylamino-6-methyl-7-(o-chloroanilino)fluoran
3-Dibutylamino-6-methyl-7-(p-chloroanilino)fluoran
3-Dibutylamino-6-methyl-7-(o-fluoroanilino)fluoran
3-Dibutylamino-6-methyl-7-(m-trifluoromethylanilino)fluoran
3-Dibutylamino-6-methyl-chlorofluoran
3-Dibutylamino-6-ethoxyethyl-7-anilinofluoran
3-Dibutylamino-6-chloro-7-anilinofluoran
3-Dibutylamino-6-methyl-7-p-methylanilinofluoran
3-Dibutylamino-7-(o-chloroanilino)fluoran
3-Dibutylamino-7-(o-fluoroanilino)fluoran
3-n-Dipentylamino-6-methyl-7-anilinofluoran
3-n-Dipentylamino-6-methyl-7-(p-chloroanilino)fluoran
3-n-Dipentylamino-6-chloro-7-anilinofluoran
3-n-Dipentylamino-7-(p-chloroanilino)fluoran
3-n-Dipentylamino-7-(m-trifluoromethylanilino)fluoran
3-Pyrrolidino-6-methyl-7-anilinofluoran
3-Piperidino-6-methyl-7-anilinofluoran
3-(N-methyl-N-n-propylamino)-6-methyl-7-anilinofluoran
3-(N-methyl-N-cyclohexylamino)-6-methyl-7-anilinofluoran
3-(N-ethyl-N-cyclohexylamino)-6-methyl-7-anilinofluoran
3-(N-ethyl-N-xylamino)-6-methyl-7-(p-chloroanilino)fluoran
3-(N-ethyl-p-toluidino)-6-methyl-7-anilinofluoran
3-(N-ethyl-N-isoamylamino)-6-methyl-7-anilinofluoran
3-(N-ethyl-N-isoamylamino)-6-chloro-7-anilinofluoran
3-(N-ethyl-N-tetrahydrofurfurylamino)-6-methyl-7-anilinofluoran
3-(N-ethyl-N-isobutylamino)-6-methyl-7-anilinofluoran
3-(N-ethyl-N-ethoxypropylamino)-6-methyl-7-anilinofluoran
3-Cyclohexylamino-6-chlorofluoran
2-(4-Oxahexyl)-3-dimethylamino-6-methyl-7-anilinofluoran
2-(4-Oxahexyl)-3-diethylamino-6-methyl-7-anilinofluoran
2-(4-Oxahexyl)-3-dipropylamino-6-methyl-7-anilinofluoran
2-Methyl-6-p-(p-dimethylaminophenyl)aminoanilinofluoran
2-Methoxy-6-p-(p-dimethylaminophenyl)aminoanilinofluoran
2-Chloro-3-methyl-6-p-(p-phenylaminophenyl)aminoanilinofluoran
2-Chloro-6-p-(p-dimethylaminophenyl)aminoanilinofluoran
2-Nitro-6-p-(p-diethylaminophenyl)aminoanilinofluoran
2-Amino-6-p-(p-diethylaminophenyl)aminoanilinofluoran
2-Diethylamino-6-p-(p-diethylaminophenyl)aminoanilinofluoran
2-Phenyl-6-metyl-p-(p-phenylaminophenyl)aminoanilinofluoran
2-Benzoyl-6-p-(p-phenylaminophenyl)aminoanilinofluoran
2-Hydroxy-6-p-(p-phenylaminophenyl)aminoanilinofluoran
3-Methyl-6-p-(p-dimethylaminophenyl)aminoanilinofluoran
3-Diethylamino-6-p-(p-diethylaminophenyl)aininoanilinofluoran
3-Diethylamino-6-p-(p-dibutylaminophenyl)aminoanilinofluoran
2,4-Dimethyl-6-[(4-dimethylamino)anilino]fluoran <Fluorene type leuco dyes>

3,6,6'-Tris(dimethylamino)spiro[fluorene-9,3'-phthalide]
3,6,6'-Tris(diethylamino)spiro[fluorene-9,3'-phthalide]

<Divinyl type leuco dyes>

3,3-Bis-[2-(p-dimethylaminophenyl)-2-(p-methoxyphenyl) ethenyl]-4,5,6,7-tetrabromophthalide
3,3-Bis-[2-(p-dimethylaminophenyl)-2-(p-methoxyphenyl) ethenyl]-4,5,6,7-tetrachlorophthalide 3,3-Bis-[1,1-bis(4-pyrrolidinophenyl)-ethylen-2-yl]-4,5,6,7-tetrabromophthalide 3,3-Bis-[1-(4-methoxyphenyl)-1-(4-pyrrolidinophenyl) ethylen-2-yl]-4,5,6,7-tetrachlorophthalide <Others>

3-(4-Diethylamino-2-ethoxyphenyl)-3-(1-ethyl-2-methylindol-3-yl)-4-azaphthalide 3-(4-Diethylamino-2-ethoxyphenyl)-3-(1-octyl-2-methylindol-3-yl)-4-azaphthalide 3-(4-Cyclohexylethylamino-2-methoxyphenyl)-3-(1-ethyl-2-methylindol-3-yl)-4-azaphthalide 3,3-Bis(1-ethy-2-methylindol-3-yl)phthalide 3,6-Bis(diethylamino)fluoran-γ-(3'-nitro)anilinolactam 3,6-Bis(diethylamino)fluoran-γ-(4'-nitro)anilinolactam 1,1-Bis-[2',2',2",2"-tetrakis-(p-dimethylaminophenyl)-ethenyl]-2,2-dinitrilethane 1,1-Bis-[2',2',2",2"-tetrakis-(p-dimethylaminophenyl)-ethenyl]-2,β-naphthoylethane 1,1-Bis-[2',2',2",2"-tetrakis-(p-dimethylaminophenyl)-ethenyl]-2,2-diacetylethane Bis-[2,2,2',2'-tetrakis-(p-dimethylaminophenyl)-ethenyl]-methylmalonic acid dimethyl ester In the present invention, prior art color developers for color developing the dye precursor can be used in combination according to the thermal resistance temperature characteristics to the objective thermal environment as far as the desired effect on the object is not hindered. While it is better to avoid using a prior art color developer when a highly heat-resistant thermal recording medium is produced. However, preferably, a very small amount of prior art color developer is used, for example, in an amount of 0.01 to 0.9 part to the compound of Formula (1) of the present invention.

Examples of such color developers include bisphenol A, 4-hydroxybenzoic acid esters, 4-hydroxyphthalic acid diesters, phthalic acid monoesters, bis-(hydroxyphenyl) sulfides, 4-hydorxyphenylarylsulfones, 4-hydroxyphenylarylsulfonates, 1,3-di[2-(hydroxyphenyl)-2-propyl]-benzenes, 4-hydroxybenzoyloxybenzoic acid ester, and bisphenolsulfones described in Japanese OPIs 03-207688 and 05-24366.

Further, in the present invention, a prior art sensitizer can be used as far as the desired effect on the object is not hindered. While it is in principle better not to use a sensitizer when a highly heat-resistant thermal recording medium is produced. However, an appropriate amount of sensitizer may be used according to the thermal resistance temperature characteristics to the objective thermal environment. Such a sensitizer includes fatty acid amides such as stearamide, palmitamide, ethylene-bisamide, montan wax, polyethylene wax, 1,2-di-(3-methylphenoxy)ethane, p-benzylbiphenyl, β-benzyloxynaphthalene, 4-biphenyl-p-tolylether, m-terphenyl, 1,2-diphenoxyethane, benzyl oxalate, di(p-chlorobenzyl) oxalate, di(p-methylbenzyl) oxalate, dibenzyl terephthalate, benzyl p-benzyloxybenzoate, di-p-tolylcarbonate, phenyl-α-naphthylcarbonate, 1,4-diethoxynaphthalene, 1-hydroxy-2-naphthoic acid phenyl ester, o-xylylene-bis-(phenylether), and 4-(m-methylphenoxymethyl)biphenyl, but is not specifically limited to these compounds. These sensitizers may be used alone or as mixtures of two or more.

As the binder used in the present invention, full saponificated polyvinyl alcohol of 200–1900 polymerization degree, partial saponificated polyvinyl alcohol, denatured polyvinyl alcohol such as denatured polyvinyl alcohol by carboxy, denatured polyvinyl alcohol by amide, denatured polyvinyl alcohol by sulfonic acid and denatured polyvinyl alcohol by butyral, derivatives of cellulose such as hydroxyethyl cellulose, methyl cellulose, ethyl cellulose, carboxymethyl cellulose and acetyl cellulose, copolymer of styrene-maleic anhydride, copolymer of styrene-butadiene, polyvinyl chloride, polyvinylacetate, polyacrylamide, polyacrylicester, polyvinylbutyral, polystyrene or copolymer of them, polyamide resin, silicon resins, petroleum resin, terpene resin, ketone resin, and coumarone resin can be illustrated. These macromolecule compounds can be applied by being dissolved into solvent such as water, alcohol, ketone, ester or hydrocarbon or by being dispersed in water or other medium under an emulsion state or a paste state, and these forms of application can be used in combination according to the quality requirement.

In the present invention, it is also possible to add known stabilizers based on metal salts (Ca, Zn) of p-nitrobenzoic acid or metal salts (Ca, Zn) of monobenzylphthalate, which have an effect to endow the recorded image with oil resistance, as much as the desired effect on the object of the present invention is not hindered.

Fillers that can be used in the present invention are inorganic or organic fillers such as silica, calcium carbonate, kaolin, calcined kaolin, diatomaceous earth, talc, titanium oxide, zinc oxide, aluminum hydroxide, polystyrene resin, urea-formaldehyde resin, styrene-methacrylic acid copolymer, styrene-butadiene copolymer, hollow plastic pigments, and the like.

In addition to the above, it is also possible to use parting agents such as fatty acid metal salts, slip agents such as waxes, benzophenone- or triazole-based ultraviolet absorbers, water resistant agents such as glyoxal, dispersants, defoamers, antioxidants, fluorescent dyes, and the like.

The substrate can be paper, synthetic paper, plastic films, non-woven fabrics, metal foils, or composite sheets thereof.

The amounts of the dye precursor, the color developer and the methylolated fatty acid amide used in the thermal recording medium of the present invention and the types and amounts of other constituents are determined according to the required properties and recording adaptability, and are not specifically limited, but it is usually preferable to use 1 to 8 parts of the color developer of Formula (1), 0.5 to 10 parts of the methylolated fatty acid amide, and 1 to 20 parts of the filler with respect to 1 part of the dye precursor, and the binder is preferably used in an amount of 10 to 25% of the total solid.

The color developer, the dye precursor, and the materials which are added as necessary are dispersed by a dispersing machine such as a ball mill, an attriter, or a sand grinder, or by an appropriate emulsifying apparatus to a particle diameter of less than several microns, and mixed with the binder and various additives according to the purpose to obtain a coating color. The coating can be made by hand coating, or using a size press coater method, a roll coater method, an air knife coater method, a blend coater method, a flow coater method, a comma direct method, a gravure direct method, a gravure reverse method, or a reverse roll coater method. Further, the coating color may be applied by spraying or dipping, and then dried.

Furthermore, the thermal recording medium of the present invention, to improve the storage stability, can be provided with an overcoating layer comprising a polymeric substance on the thermal recording layer or, to improve the storage stability and sensitivity, with an undercoating layer containing an organic or inorganic filler between the recording layer and the substrate.

In the thermal recording medium of the present invention, a light absorbent which absorbs light to convert it to heat can be contained in the thermal recording layer to obtain an optically recordable thermal recording medium. The light absorbent may be a substance which absorbs the emission wavelength of various light sources, and various dyestuffs, pigments, or near-infrared absorbents can be used, which are not specifically limited.

Since the thermal recording medium of the present invention is superior in heat resistance and very high in thermal stability of the background color, it can be heat laminated with a plastic film to provide a strong protective film. Therefore, before or after recording with heat or light, using a commercial laminator, it can be easily heat laminated with a plastic film using a commercial laminator to obtain a card protected with a plastic film with improved heat resistance and stabilities. The base material of the heat lamination plastic film includes polyethylene terephthalate (PET), polypropylene (PP), and the like, and the heat sealing agent for the heat lamination plastic film can be thermoplastic resins such as low-density polyethylene, ethylene/vinyl acetate copolymer (EVA), ethylene/ethyl acrylate copolymer (EEA), ethylene/methyl methacrylate copolymer (EMAA), and ethylene/methacrylic acid copolymer (EMAA).

In addition, the thermal recording medium of the present invention can be extrusion coated with an extrusion coating resin. The extrusion coating resin includes the thermoplastic resins usable for the above heat sealing agent, polypropylene (PP) and polyethylene terephthalate (PET).

Since the thermal recording medium of the present invention is superior in thermal resistance, the background color will not be developed even if contacted with a thermal fixing unit of toner of an electrophotographic copier. Therefore, the recording medium can also be used as an electrophotographic copy paper. Recording with heat is also possible before or after toner recording by an electrophotographic copier.

DETAILED DESCRIPTION OF EXAMPLES

Production of Thermal Recording Medium: Examples 1–15, Comparative Examples 1–5

The thermal recording medium of the present invention will now be described with reference to the Examples. In the following description, part and % indicate part by weight and % by weight, respectively. The solutions, dispersions, or coating colors were prepared as follows.

Examples 1–6

Examples 1 to 6 use the compounds A-1, A-10, A-13, A-19, A-40 and B-5 as color developers, and 3-diethylamino-6-methyl-7-anilinofluoran (hereinafter referred to as ODB) as a dye precursor, and $C_{17}H_{35}CONHCH_2OH$ as a methylolated fatty acid amide in the thermal recording medium of the present invention.

A color developer dispersion (Liquid A), a dye precursor dispersion (Liquid B), and a dispersion (Liquid C) of methylolated fatty acid amide of Formula (2) of the following compositions were separately wet milled by a sand grinder to an average particle diameter of 1 micron.

| Liquid A (color developer dispersion) | |
|---|---|
| Color developer | 6.0 parts |
| 10% Aqueous polyvinylalcohol solution | 18.8 parts |
| Water | 11.2 parts |
| Liquid B (dye precursor dispersion) | |
| 3-Diethylamino-6-methyl-7-anilinofluoran (ODB) | 2.0 parts |
| 10% Aqueous polyvinylalcohol solution | 4.6 parts |
| Water | 2.6 parts |
| Liquid C (methylolated fatty acid amide dispersion) | |
| $C_{17}H_{35}CONHCH_2OH$ | 4.0 parts |
| 10% Aqueous polyvinylalcohol solution | 18.8 parts |
| Water | 11.2 parts |

Next, the dispersions were mixed in the following ratio to obtain a coating color.

| | |
|---|---|
| Liquid A (color developer dispersion) | 36.0 parts |
| Liquid B (dye precursor [ODB] dispersion) | 9.2 parts |
| Liquid C (methylolated fatty acid amide disp.) | 34.0 parts |
| Kaolin clay (50% dispersion) | 12.0 parts |

The coating color was coated on one side of a substrate (60 g/m$^2$ base paper), dried, and supercalendered to a flatness of 500 to 600 seconds to obtain a thermal recording medium with a coating amount of 6.0 g/m$^2$.

Examples 7–10

Examples 7–10 use the compound of (A-10) as a color developer, the following dye precursors other than ODB, and $C_{17}I_{35}CONHCH_2OH$ as a methylolated fatty acid amide.

(Dye precursor)

ODB-2: 3-dibutylamino-6-methyl-7-anilinofluoran

PSD-170: 3-pyrrolidino-6-methyl-7-anilinofluoran

BLACK 100: 3-diethylamino-7-(m-trifluoromethylanilino)fluoran

CVL: 3,3-bis(p-dimethylaminophenyl)-6-dimethylaminophthalide

The color developer dispersion of compound A-10 and the dispersion of $C_{17}H_{35}CONHCH_2OH$ were treated as in Examples 1–6. The dye precursor dispersions other than ODB (Liquid D) were separately wet milled by a sand grinder to an average particle diameter of 1 micron.

| Liquid D (dye precursor dispersion other than ODB) | |
|---|---|
| Dye precursor | 2.0 parts |
| 10% Aqueous polyvinylalcohol solution | 4.6 parts |
| Water | 2.6 parts |

Next, the dispersions were mixed in the following ratio to obtain a coating color.

| | |
|---|---|
| Liquid A (color developer [A-10] dispersion) | 36.0 parts |
| Liquid D (dye precursor dispersion other than ODB) | 9.2 parts |
| Liquid C ($C_{17}H_{35}CONHCH_2OH$ dispersion) | 34.0 parts |
| Kaolin clay (50% dispersion) | 12.0 parts |

The coating color was coated on one side of a substrate (60 g/m$^2$ base paper), dried, and supercalendered to a smoothness of 500 to 600 seconds to obtain a thermal recording medium with a coating amount of 6.0 g/m$^2$.

Examples 11 and 12

Example 11 and 12 use the compound A-10 as a color developer, ODB as a dye precursor, and $C_{15}H_{31}CONHCH_2OH$ and $C_{21}H_{43}CONHCH_2OH$ as methylolated fatty acid amides of Formula (2). The color developer dispersion of compound A-10 and the ODB dispersion were treated as in Examples 1–6, and $C_{15}H_{31}CONHCH_2OH$ and $C_{21}H_{43}CONHCH_2OH$ were treated as in the case of $C_{17}H_{35}CONHCH_2OH$ to obtain Dispersion E.

Next, the dispersions were mixed in the following ratio and stirred to obtain a coating color.

| | |
|---|---|
| Liquid A (color developer [A-10] dispersion) | 36.0 parts |
| Liquid B (dye precursor [ODB] dispersion) | 9.2 parts |
| Liquid E (methylolated fatty acid amide disp.) | 34.0 parts |
| Kaolin clay (50% dispersion) | 12.0 parts |

The coating color was coated on one side of a substrate (60 g/m$^2$ base paper), dried, and supercalendered to a smoothness of 500 to 600 seconds to obtain a thermal recording medium with a coating amount of 6.0 g/m$^2$.

Example 13

Example 13 uses the compounds A-1 and A-10 as color developers, ODB as a dye precursor, and $C_{17}H_{35}CONHCH_2OH$ as a methylolated fatty acid amide. The compound A-1 and A-10 dispersions, the ODB dispersion, and the $C_{17}H_{35}CONHCH_2OH$ dispersion were treated as in Examples 1–6.

Next, the dispersions were mixed in the following ratio and stirred to obtain a coating color.

| | |
|---|---|
| Liquid A (color developer [A-1] dispersion) | 18.0 parts |
| Liquid A (color developer [A-10] dispersion) | 18.0 parts |
| Liquid B (dye precursor [ODB] dispersion) | 9.2 parts |
| Liquid C ($C_{17}H_{35}CONHCH_2OH$ dispersion) | 34.0 parts |
| Kaolin clay (50% dispersion) | 12.0 parts |

The coating color was coated on one side of a substrate (60 g/m$^2$ base paper), dried, and supercalendered to a smoothness of 500 to 600 seconds to obtain a thermal recording medium with a coating amount of 6.0 g/m$^2$.

Example 14

Example 14 uses A-10 as a color developer, and ODB and PSD-170 as dye precursors, and $C_{17}H_{35}CONHCH_2OH$ as a methylolated fatty acid amide. The color developer dispersion of compound A-10, the ODB and PSD-170 dispersions, and the $C_{17}H_{35}CONHCH_2OH$ dispersion were treated as in Examples 1–10.

Next, the dispersions were mixed in the following ratio and stirred to obtain a coating color.

| | |
|---|---|
| Liquid A (color developer [A-10] dispersion) | 36.0 parts |
| Liquid B (dye precursor [ODB] dispersion) | 4.6 parts |
| Liquid D (dye precursor [PSD-170] dispersion | 4.6 parts |
| Liquid C ($C_{17}H_{35}CONHCH_2OH$ dispersion) | 34.0 parts |
| Kaolin clay (50% dispersion) | 12.0 parts |

The coating color was coated on one side of a substrate (60 g/m$^2$ base paper), dried, and supercalendered to a smoothness of 500 to 600 seconds to obtain a thermal recording medium with a coating amount of 6.0 g/m$^2$.

Example 15

Example 15 uses A-10 as a color developer, ODB as a dye precursor, and $C_{15}H_{31}CONHCH_2OH$ and $C_{21}H_{43}CONHCH_2OH$ as methylolated fatty acid amides. The color developer dispersion of compound A-10, the ODB dispersion, and $C_{15}H_{31}CONHCH_2OH$ and $C_{21}H_{43}CONHCH_2OH$ dispersions were treated as in Examples 1–12.

Next, the dispersions were mixed in the following ratio and stirred to obtain a coating color.

| | |
|---|---|
| Liquid A (color developer [A-10] dispersion) | 36.0 parts |
| Liquid B (dye precursor [ODB] dispersion) | 9.2 parts |
| Liquid C ($C_{17}H_{35}CONHCH_2OH$ dispersion) | 17.0 parts |
| Liquid E ($C_{15}H_{31}CONHCH_2OH$ dispersion) | 17.0 parts |
| Kaolin clay (50% dispersion) | 12.0 parts |

The coating color was coated on one side of a substrate (60 g/m$^2$ base paper), dried, and supercalendered to a smoothness of 500 to 600 seconds to obtain a thermal recording medium with a coating amount of 6.0 g/m$^2$.

Comparative Example 1

The same procedure as in Example 2 was used, except that Liquid C was removed.

Comparative Example 2

The same procedure as in Example 4 was used, except that Liquid C was removed, and ODB2 was used as a dye precursor.

Comparative Example 3

A dispersion of bisphenol A (hereinafter referred to as BPA) as a comparative color developer of the following composition (hereinafter referred to as Liquid F) was wet milled by a sand grinder to an average particle diameter of 1 micron.

| Liquid F (BPA dispersion) | |
|---|---|
| Bisphenol A (BPA) | 6.0 parts |
| 10% Aqueous polyvinylalcohol solution | 18.8 parts |
| Water | 11.2 parts |

Next, the Liquids F and B were mixed in the following ratio to obtain a recording layer coating color. Recording layer coating color.

| | |
|---|---|
| Liquid F (BPA dispersion) | 36.0 parts |
| Liquid B (dye precursor dispersion) | 9.2 parts |
| Kaolin clay (50% dispersion) | 12.0 parts |

The coating color was coated on one side of a substrate (60 g/m$^2$ base paper), dried, and supercalendered to a smoothness of 500 to 600 seconds to obtain a thermal recording medium with a coating amount of 6.0 g/m$^2$.

Comparative Example 4

The same procedure as in Comparative Example 3 was used, except that Liquid C of methylolated fatty acid amide shown in Table 1 was added.

Comparative Example 5

A dispersion of stearamide as a sensitizer (Liquid G) of the following composition was wet milled by a sand grinder to an average particle diameter of 1 micron.

| Liquid G (stearamide dispersion) | |
|---|---|
| Stearamide | 4.0 parts |
| 10% Aqueous polyvinylalcohol solution | 18.8 parts |
| Water | 11.2 parts |

Next, the Liquids G, A and B were mixed in the following ratio to obtain a recording layer coating color. Recording layer coating color.

| | |
|---|---|
| Liquid A (color developer [A-10] dispersion) | 36.0 parts |
| Liquid B (dye precursor [ODB] dispersion) | 9.2 parts |
| Liquid G (stearamide dispersion) | 34.0 parts |
| Kaolin clay (50% dispersion) | 12.0 parts |

The coating color was coated on one side of a substrate (60 g/m$^2$ base paper), dried, and supercalendered to a smoothness of 500 to 600 seconds to obtain a thermal recording medium with a coating amount of 6.0 g/m$^2$.

Evaluation of Thermal Recording Media: Examples 1–15, Comparative Examples 1–5

The thermal recording media of Examples 1–15 and Comparative Examples 1–5 were tested for thermal recordability (recording density and background color density) and plasticizer resistance (Table 1: Thermal recording characteristics (recording density and background color) and plasticizer resistance of Example 1–15).

[Thermal Recording Characteristic Test (Dynamic Color Developing Density)]

Thermal recording was carried out on the thermal recording media of Examples 1–15 and Comparative Examples 1–5 using a printer of a personal word processor Rupo-90FII (Toshiba) at a maximum application energy (same condition used for the subsequent tests). Recording density of the recorded portion was measured by means of a Macbeth densitometer (RD-914, amber filter used, hereinafter the same condition used).

A sufficient recording density was obtained with the thermal recording media of Examples 1–15 using the compounds of the present invention as color developers by the above printer.

[Plasticizer Resistance Test]

A single sheet of polyvinylchloride wrap HIGHWRAP KMA (Mitsui Toatsu Chemicals) was wound round on a paper tube, stuck thereon a thermal recording medium recorded by the above printer, further wound round with 3 plies of the polyvinylchloride wrap, allowed to stand at 40° C. for 4 hours, and measured for the Macbeth density of the image portion and background portion.

In the thermal recording media of Example 1–15 of the present invention, the recorded image remained almost unchanged, and no color development was noted in the background portion. On the other hand, each of the thermal recording media of Comparative Examples was adversely affected by the plasticizer and, in particular, retention of the image portion was less than a half. Specifically, considerable discoloration of the image was noted in Comparative Examples 1 and 2 which do not contain the methylolated fatty acid amide of Formula (2), and discoloration and coloring of the background portion occurred in Comparative Example 3 which also does not use the color developer of Formula (1) of the present invention. Further, the plasticizer resistance was considerably inferior in both the image portion and background portion in Comparative Example 4 which contains the methylolated fatty acid amide of Formula (2) but does not use the color developer of the present invention. Yet further, discoloration of the image portion occurred in Comparative Example 5 which uses the color developer of the present invention and stearamide.

[Thermal Stability Test of Background Color]

Using a Gear type aging tester (Toyoseiki Seisakusho), the thermal recording media of Examples 1–15 and Comparative Examples 1–5 were subjected to a thermal resistance test at 110° C. (2 hours). After the thermal resistance test, the background density was measured by the Macbeth densitometer. In this case, the smaller the value of Macbeth density, the smaller development of background color, and the higher the thermal stability of background color.

While the thermal recording media of Examples 1–15 using the compounds of the present invention as color developers had no samples exceeding 0.1 in background density after 2 hours at 110° C., showing good thermal stability in spite of the addition of the methylolated fatty acid amide. On the other hand, particularly Comparative Examples 3 and 4 using a color developer other than that of the present invention exceeded a density of 0.6 resulting in a very strong background color development.

TABLE 1

Thermal recording characteristics (recording density and background stability) and plasticizer resistance of Examples 1–15 and Comparative Examples 1–5

| Example | Color developer | Dye precursor | Formula (2) compound (methylolated fatty acid amide *2) | Image density | Background density | Plasticizer resistance *1 Image | Plasticizer resistance *1 Back | Thermal stability of background color (110° C. for 2 hrs) |
|---|---|---|---|---|---|---|---|---|
| Example 1 | A-1 | ODB | $C_{17}H_{35}CONHCH_2OH$ | 1.40 | 0.03 | 1.37 | 0.03 | 0.09 |
| Example 2 | A-10 | ODB | $C_{17}H_{35}CONHCH_2OH$ | 1.41 | 0.03 | 1.37 | 0.03 | 0.07 |
| Example 3 | A-13 | ODB | $C_{17}H_{35}CONHCH_2OH$ | 1.44 | 0.03 | 1.40 | 0.03 | 0.07 |
| Example 4 | A-19 | ODB | $C_{17}H_{35}CONHCH_2OH$ | 1.40 | 0.03 | 1.38 | 0.03 | 0.08 |
| Example 5 | A-40 | ODB | $C_{17}H_{35}CONHCH_2OH$ | 1.35 | 0.03 | 1.34 | 0.03 | 0.06 |
| Example 6 | B-5 | ODB | $C_{17}H_{35}CONHCH_2OH$ | 1.34 | 0.03 | 1.32 | 0.03 | 0.08 |

TABLE 1-continued

Thermal recording characteristics (recording density and background stability) and plasticizer resistance of Examples 1–15 and Comparative Examples 1–5

| Example | Color developer | Dye precursor | Formula (2) compound (methylolated fatty acid amide *2) | Image density | Background density | Plasticizer resistance *1 Image | Plasticizer resistance *1 Back | Thermal stability of background color (110° C. for 2 hrs) |
|---|---|---|---|---|---|---|---|---|
| Example 7 | A-10 | ODB-2 | $C_{17}H_{35}CONHCH_2OH$ | 1.40 | 0.03 | 1.35 | 0.03 | 0.06 |
| Example 8 | A-10 | PSD-170 | $C_{17}H_{35}CONHCH_2OH$ | 1.41 | 0.04 | 1.36 | 0.04 | 0.08 |
| Example 9 | A-10 | BLACK 100 | $C_{17}H_{35}CONHCH_2OH$ | 1.34 | 0.03 | 1.29 | 0.03 | 0.06 |
| Example 10 | A-10 | CVL | $C_{17}H_{35}CONHCH_2OH$ | 1.45 | 0.03 | 1.25 | 0.03 | 0.08 |
| Example 11 | A-10 | ODB | $C_{15}H_{31}CONHCH_2OH$ | 1.40 | 0.03 | 1.36 | 0.03 | 0.07 |
| Example 12 | A-10 | ODB | $C_{21}H_{43}CONHCH_2OH$ | 1.38 | 0.03 | 1.34 | 0.03 | 0.06 |
| Example 13 | A-1/A-10 | ODB | $C_{17}H_{35}CONHCH_2OH$ | 1.41 | 0.03 | 1.38 | 0.03 | 0.09 |
| Example 14 | A-10 | ODB/PSD-170 | $C_{17}H_{35}CONHCH_2OH$ | 1.41 | 0.03 | 1.37 | 0.03 | 0.07 |
| Example 15 | A-10 | ODB | $C_{15}H_{31}CONHCH_2OH$ $C_{17}H_{35}CONHCH_2OH$ | 1.40 | 0.03 | 1.36 | 0.03 | 0.07 |
| Comp. Ex. 1 | A-10 | ODB | — | 1.36 | 0.03 | 0.52 | 0.03 | 0.07 |
| Comp. Ex. 2 | A-19 | ODB-2 | — | 1.36 | 0.03 | 0.43 | 0.03 | 0.04 |
| Comp. Ex. 3 | BPA | ODB | — | 1.44 | 0.05 | 0.13 | 0.07 | 0.63 |
| Comp. Ex. 4 | BPA | ODB | $C_{17}H_{35}CONHCH_2OH$ | 1.45 | 0.05 | 0.09 | 0.07 | 1.20 |
| Comp. Ex. 5 | A-10 | ODB | $C_{17}H_{35}CONH_2$ | 1.44 | 0.03 | 0.31 | 0.04 | 0.18 |

*1: Treated at 40° C. for 4 hours,
*2: stearamide used only in Comparative Example 5.

As can be seen from Table 1, when a non-methylolated fatty acid amide is used in combination with the compound of Formula (1), the thermal stability of the background portion is rather impaired as compared with the case where no fatty acid amide is used (from Comparative Examples 1, 2, and 5). Further, when bisphenol A known as a prior art color developer is used, plasticizer resistance of the image portion and thermal stability of the background portion are deteriorated by the addition of the methylolated fatty acid amide (from Comparative Example 3 and 4). As described above, a thermal recording medium with superior thermal resistance and plasticizer resistance can only be obtained by the present invention which uses the compound of Formula (1) in combination with the methylolated fatty acid amide of Formula (2).

The thermal recording medium of the present invention has a high thermal resistance and is very strong in plasticizer resistance of the recorded image and the background portion. Therefore, the present invention provides the following effects.

(1) Even if contacted with a plasticizer contained in wrap films and other matters used in the daily life, the recorded image is not discolored with improved practicability, and the background portion does not undergo coloring, thereby preventing degradation of appearance.

(2) Since the thermal recording medium of the present invention can be heated in a microwave oven or sterilized at high temperatures in the state adhered to a wrap film, it is very useful in food labeling and medical applications.

(3) Since the thermal recording medium of the present invention contains the color developer of Formula (1) and the methylolated fatty acid amide of Formula (2) in the recording layer, thermal recording can be achieved at least by a single coating to form a layer with superior thermal resistance and plasticizer resistance, thereby providing improved economy.

What is claimed is:

1. A thermal recording medium comprising a substrate having thereon a recording layer containing a colorless or pale colored dye precursor, and a color developer reactable with the dye precursor to develop a color as main ingredients, wherein said color developer includes at least one compound of Formula (1):

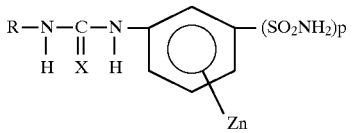

(1)

wherein X is an oxygen atom or sulfur atom; and R is a substituted or unsubstituted group which is selected from the group consisting of phenyl group, naphthyl group, aralkyl group, a lower alkyl group of 1 to 6 carbon atoms, a cycloalkyl group of 3 to 6 carbon atoms, and a lower alkenyl group of 2 to 6 carbon atoms, Z is a lower alkyl group of 1 to 6 carbon atoms or an electron attracting group, n is an integer from 0 to 4, and p is an integer from 1 to 5, satisfying $n+p \leqq 5$, and wherein the recording layer contains at least one methylolated fatty acid amide of the Formula (2):

$$R_1\text{-}CONHCH_2OH \quad (2)$$

wherein $R_1$ is an alkyl group of 11 to 21 carbon atoms.

2. The thermal recording medium according to claim 1 wherein in Formula (1) p is an integer from 1 to 3.

3. The thermal recording medium according to claim 2 wherein in Formula (2) $R_1$ is an alkyl group selected from the group consisting of 15, 17 and 21 carbon atoms and mixtures thereof.

4. The thermal recording medium according to claim 1 wherein in Formula (2) $R_1$ is an alkyl group selected from the group consisting of 15, 17 and 21 carbon atoms and mixtures thereof.

5. The thermal recording medium of claim 1 wherein in the Formula (1) the R group includes a substituent selected from the group consisting of methyl, ethyl, isopropenyl, fluorine, chlorine, bromine and nitro.

6. The thermal recording medium of claim 1, wherein in the Formula (1) Z is a member selected from the group consisting of methyl, ethyl, fluorine, chlorine, bromine and nitro.

7. A thermal recording medium according to claim 1 comprising a color developer, wherein the color developer includes at least one compound of Formula:

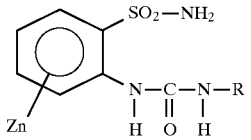

R is a substituted or unsubstituted group selected from the group consisting of an alkyl group having 1 to 3 carbon atoms, a cyclohexyl group, a propenyl group and a naphthyl group, wherein the alkyl group may contain a phenyl substituent, a methyl phenyl substituent or a propenyl phenyl substitutent, and Z is methyl and n is an integer of from 0 to 1.

8. The thermal recording medium of claim 7 wherein the alkyl group is a member selected from the group consisting of methyl, isopropyl and propenyl.

9. A thermal recording medium according to claim 1 comprising a color developer, wherein the color developer includes at least one compound of Formula:

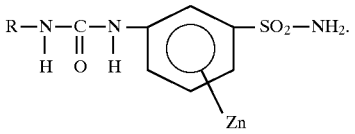

R is a substituted or unsubstituted group selected from the group consisting of an alkyl group having 1 to 3 carbon atoms, a cyclohexyl group, a propenyl group and a naphthyl group, wherein the alkyl group may contain a phenyl substituent, a chlorophenyl substituent or a propenyl phenyl substitutent, and Z is methyl or chlorine and n is an integer of from 0 to 3.

10. The thermal recording medium of claim 9 wherein the alkyl group is a member selected from the group consisting of methyl, isopropyl, propyl and propenyl.

11. A thermal recording medium according to claim 1 comprising a color developer, wherein the color developer includes at least one compound of Formula:

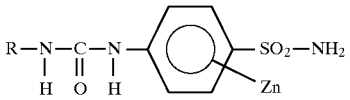

R is a substituted or unsubstituted group selected from the group consisting of an alkyl group having 1 to 3 carbon atoms, a cyclohexyl group, a methyl cyclohexyl group, a vinyl group and naphthyl group, wherein the alkyl group may contain a phenyl substituent, a bromo phenyl substituent or a propenyl phenyl substitutent, and Z is bromine and n is an integer of from 0 to 2.

12. The thermal recording medium of claim 11 wherein the alkyl group is a member selected from the group consisting of methyl, isopropyl and propenyl.

13. A thermal recording medium comprising a substrate having thereon a recording layer containing a colorless or pale colored dye precursor, and a color developer reactable with the dye precursor to develop a color as main ingredients, wherein the color developer includes at least one compound of Formula:

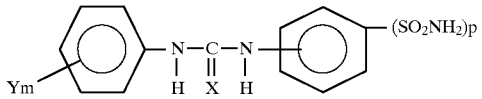

wherein X is oxygen atom, Y is a lower alkyl group of 1 to 6 carbon atoms or an electron attracting group and m is an integer from 0 to 3 and p is 1 to 3, and wherein the recording layer contains at least one methylolated fatty acid amide of the Formula (2):

$$R_1\text{-}CONHCH_2OH \quad (2)$$

wherein $R_1$ is an alkyl group of 15 to 21 carbon atoms.

14. A thermal recording medium according to claim 13, comprising a color developer, wherein the color developer includes at least one compound of Formula:

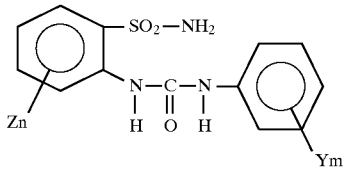

wherein Y is a member selected from the group consisting of ethyl, methoxy, chlorine, bromine, nitro and CN and m is an integer from 0 to 3, Z is bromine and n is an integer from 0 to 1.

15. A thermal recording medium according to claim 13 comprising a color developer, wherein the color developer includes at least one compound of Formula:

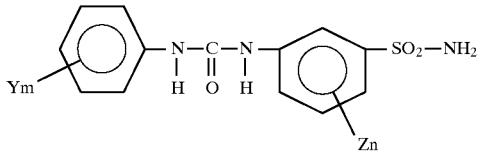

wherein Z is chlorine and n is an integer from 0 to 2, Y is a member selected from the group consisting of methyl, methoxy, chlorine, bromine and nitro and m is an integer from 0 to 2.

16. A thermal recording medium according to claim 13 comprising a color developer, wherein the color developer includes at least one compound of Formula:

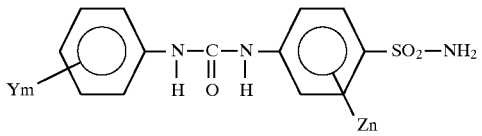

wherein Y is a member selected from the group consisting of methyl, chlorine, fluorine, methoxy and nitro and m is an integer from 0 to 2, and Z is chlorine and n is an integer of 0 to 2.

17. A thermal recording medium comprising a substrate having thereon a recording layer containing a colorless or pale colored dye precursor, and a color developer reactable with the dye precursor to develop a color as main ingredients, wherein the color developer includes at least one compound of Formula:

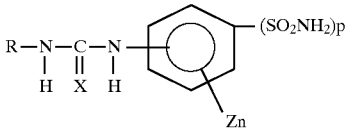

wherein X is sulfur atom; and R is a substituted or unsubstituted group which is selected from the group consisting of phenyl group, naphthyl group, aralkyl group, a lower alkyl group of 1 to 6 carbon atoms, cycloalkyl group of 3 to 6 carbon atoms, and a lower alkenyl group of 2 to 6 carbon atoms, Z is a lower alkyl group of 1 to 6 carbon atoms or an electron attracting group, n is an integer from 0 to 4, and p is an integer of 1 to 5, satisfying n+p≦5, and wherein the recording layer contains at least one methylolated fatty acid amide of the Formula (2):

$$R_1\text{-}CONHCH_2OH \quad (2)$$

wherein $R_1$ is an alkyl group of 11 to 21 carbon atoms.

18. The thermal recording medium of claim 17, wherein the R group includes a substituent selected from the group consisting of methyl, ethyl, isopropenyl, fluorine, chlorine, bromine and nitro.

19. The thermal recording medium of claim 17, wherein Z is a member selected from the group consisting of methyl, ethyl, fluorine, chlorine, bromine and nitro.

20. A thermal recording medium according to claim 17 comprising a color developer, wherein the color developer includes at least one compound of Formula:

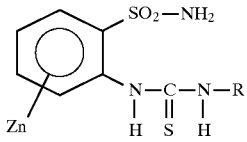

R is a substituted or unsubstituted alkyl group having 1 to 3 carbon atoms, wherein the alkyl group may contain a phenyl substituent or a propenyl phenyl substituent and Z is methyl and n is an integer of from 0 to 1.

21. The thermal recording medium of claim 20 wherein the alkyl group is a member selected from group consisting of methyl, isopropyl and propyl.

22. A thermal recording medium according to claim 17 comprising color developer, wherein the color developer includes at least one compound of Formula:

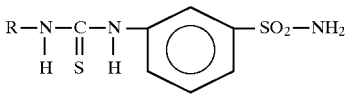

R is a substituted or unsubstituted group selected from the group consisting of an alkyl group having 1 to 3 carbon atoms, a cyclohexyl group, and a naphthyl group, wherein the alkyl group may contain a propenyl phenyl substituent.

23. The thermal recording medium of claim 22, wherein the alkyl group is isopropyl.

24. A thermal recording medium according to claim 17 comprising a color developer, wherein the color developer includes at least one compound of Formula:

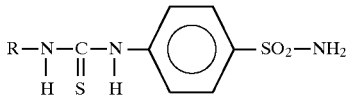

R is a substituted or unsubstituted group selected from the group consisting of an alkyl group having 1 to 3 carbon atoms, a cyclohexyl group and a propenyl group, wherein the alkyl group may contain a phenyl substituent.

25. The thermal recording medium of claim 24 wherein the alkyl group is methyl.

26. A thermal recording medium comprising a substrate having thereon a recording layer containing a colorless or pale colored dye precursor, and a color developer reactable with the dye precursor to develop a color as main ingredients, wherein the color developer includes at least one compound of Formula:

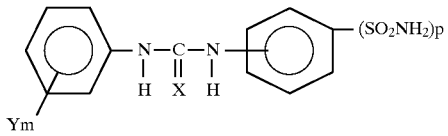

wherein X is sulfur atom, Y is a lower alkyl group of 1 to 6 carbon atoms or an electron attracting group, and m is an integer from 0 to 3, and p is 1 to 3, and wherein the recording layer contains at least one methylated fatty acid amide of the Formula (2):

$$R_1\text{-}CONHCH_2OH \quad (2)$$

wherein $R_1$ is an alkyl group of 15 to 21 carbon atoms.

27. A thermal recording medium according to claim 26 comprising a color developer, wherein the color developer includes at least one compound of Formula:

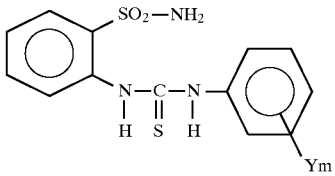

wherein Y is methoxy and m is an integer from 0 to 1.

28. A thermal recording medium according to claim 26 comprising a color developer, wherein the color developer includes at least one compound of Formula:

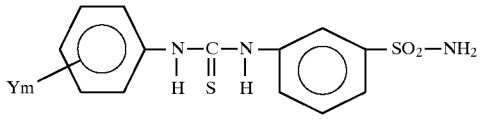

wherein Y is chlorine and m is an integer from 0 to 2.

29. A thermal recording medium according to claim 26 comprising color developer, wherein the color developer includes at least one compound of Formula:

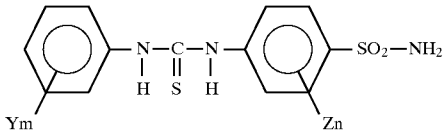
wherein Y is a member selected from the group consisting of methyl, methoxy and chlorine and m is an integer from 0 to 1, and Z is chlorine and n is an integer from 0 to 4.
* * * * *